US010292476B2

(12) United States Patent
Barrett

(10) Patent No.: US 10,292,476 B2
(45) Date of Patent: May 21, 2019

(54) NAIL CARE DEVICE

(71) Applicant: Chadwick G Barrett, Bronx, NY (US)

(72) Inventor: Chadwick G Barrett, Bronx, NY (US)

( * ) Notice: Subject to any disclaimer, the term of this patent is extended or adjusted under 35 U.S.C. 154(b) by 58 days.

(21) Appl. No.: 14/856,515

(22) Filed: Sep. 16, 2015

(65) Prior Publication Data

US 2017/0071313 A1 Mar. 16, 2017

(51) Int. Cl.

*A45D 29/14* (2006.01)
*A45D 29/17* (2006.01)
*A46B 13/00* (2006.01)

(52) U.S. Cl.

CPC ..... *A45D 29/14* (2013.01); *A45D 29/17* (2013.01); *A46B 13/001* (2013.01)

(58) Field of Classification Search

CPC ..... A45D 29/14; A45D 29/05; A45D 29/06; A45D 29/17; A45D 29/22; A46B 13/00; A46B 13/001; A46B 13/02; A46B 2200/1013

USPC ..... 132/73.6

See application file for complete search history.

(56) References Cited

U.S. PATENT DOCUMENTS 4,016,890 A * 4/1977 Fiorenza, Sr. ..... A45D 29/05 132/75.6
4,255,826 A * 3/1981 Boyd ..... A46B 13/04 132/73.6
4,800,606 A * 1/1989 Kolesky ..... A45D 29/007 132/73.6
5,007,441 A * 4/1991 Goldstein ..... A45D 29/007 132/73.6
5,348,029 A * 9/1994 Garcia Rodriguez ..... A45D 34/04 132/73.5
5,379,474 A * 1/1995 Nakamura ..... A46B 13/02 132/73.6
5,823,203 A * 10/1998 Carroll ..... A45D 29/007 132/200
6,016,812 A * 1/2000 Guynn ..... A45D 29/17 132/73
6,116,248 A 9/2000 Walker
6,314,965 B1 * 11/2001 Walker ..... A45D 29/007 132/74.5
7,267,125 B2 * 9/2007 Nevakshonoff ..... B24B 23/02 132/73.6
9,433,274 B1 * 9/2016 Morrison ..... A45D 29/17
2002/0050278 A1 * 5/2002 Jo ..... A61B 17/54 132/73.6

(Continued)

*Primary Examiner* — Tatiana Nobrega
*Assistant Examiner* — Jennifer Gill
(74) *Attorney, Agent, or Firm* — S&L US IP Attorneys, P.C.; Timothy Marc Shropshire; Eric Brandon Lovell

(57) ABSTRACT

A nail care device for cleaning and buffing nails comprising; a housing having a front housing cavity that is open on one end with the open end configured for horizontal insertion of a digit nail, a digit positioner placed at said open front cavity, an open at one end hallow interchangeable bristle case with bristles protruding inward providing contact to nail directly connected to an axle enclosed in the middle of the housing cavity, a motor connected to said bristle case by said axle and that motor be located directly behind a closed end of the bristle case, a ball bearing ring for smoother rotation of bristle case disposed in housing cavity between said front cavity and said bristle case, a power source providing power to said motor and, a power control.

8 Claims, 4 Drawing Sheets

(56) References Cited

U.S. PATENT DOCUMENTS

| | | | | |
|---|---|---|---|---|
| 2010/0263145 | A1* | 10/2010 | Chen | A46B 5/0095 15/160 |
| 2012/0192895 | A1* | 8/2012 | Shatz | A46B 9/026 134/6 |
| 2013/0056020 | A1* | 3/2013 | Wilson | A45D 34/041 132/320 |

* cited by examiner

NAIL CARE DEVICE

CROSS-REFERENCE TO RELATED APPLICATIONS

Not applicable.

BACKGROUND OF THE INVENTION

Field of Invention

The present invention relates primarily to personal cleaning apparatuses and devices, and particularly to apparatuses and devices for nail cleaning and care. In particular, the present invention is a beauty care device for personal presentation and hygiene

SUMMARY OF THE INVENTION

A professional manicure provides satisfying appearance of fingernails at the expense of cost and time. The present invention provides an alternative cleaning for everyday use and activities that deposit dirt under nails, e.g., running fingers through hair, and touching soil and dirty objects.

The present invention provides a small personal portable device containing a motor, a power source, a finger stopper and a bristle case with bristles that can be used to clean, polish and/or maintain a user's fingernails on the go.

In an embodiment the portable nail care device includes: a housing having an internal cavity, wherein the housing is open on one end; a finger stopper; a hollow bristle case disposed within the housing cavity, the bristle case being open at one end and having bristles disposed within, and protruding inward from the interior walls of the bristle case; a motor disposed in the housing cavity; a ball bearing ring disposed in the housing cavity for smoother movement of the bristle case; a power source providing power to the motor; and a power switch.

In an embodiment, the nail care device is battery-operated. The nail care device is adapted and arranged to operate to loosen and remove moist soil and dirt from a user's fingernail or toenail. Upon placing a linger or toe on a first position of the finger stopper, the user can activate the power switch to initiate movement of the bristle clusters to loosen and remove dirt from the user's nail(s) An exemplary method of using the device includes the steps of: (1) placing a finger on the finger stopper; (2) activating the power switch to allow the brush to clean and/or polish the user's nail; (3) adjusting the user's finger for better friction; (4) deactivating the power switch. (5) removing the user's finger from the finger stopper; and repealing the method for the user's remaining fingers and/or toes.

Uses of the present device are cleaning, polishing, and/or maintaining fingernails. The device may also accommodate cleaning, polishing and/or maintaining toenails, if suitable and desired. The nail cleaner and polishing device can be used as a toe nail cleaner and polisher with optimal length, width and depth, wherein the casing cavity and/or bristle casing cavity would provide a suitable fit In an embodiment, the device includes a charger for one or more devices. In a further embodiment, the charger is wireless. In a further embodiment, the device includes a display stand for displaying one or more devices. In yet a further embodiment, the device includes a display box for displaying one or more devices.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1A:
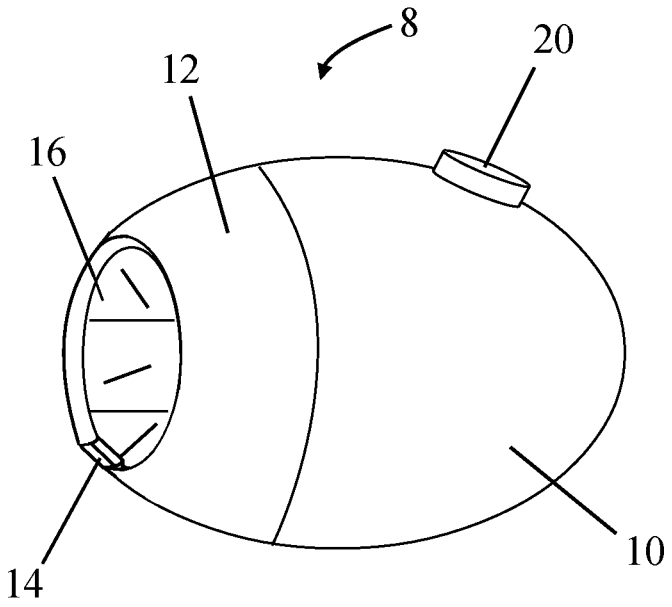
FIG. 1A is a perspective view of a nail care device, according to an embodiment of the present invention.

Preferred embodiments of the present invention and their advantages may be understood by referring to FIGS. 1A-3, wherein like reference numerals refer to like elements.

Referring to FIGS. 1A-3, the nail care device includes: a housing 8 having an internal cavity, the housing being open on one end; a finger stopper 14, a bristle case 16; bristles 26: a power switch 20; a motor 22; and a battery 24. The housing 8 may also include a ball bearing ring 28 for smoother movement of the bristle case 16.

Figure 1B:
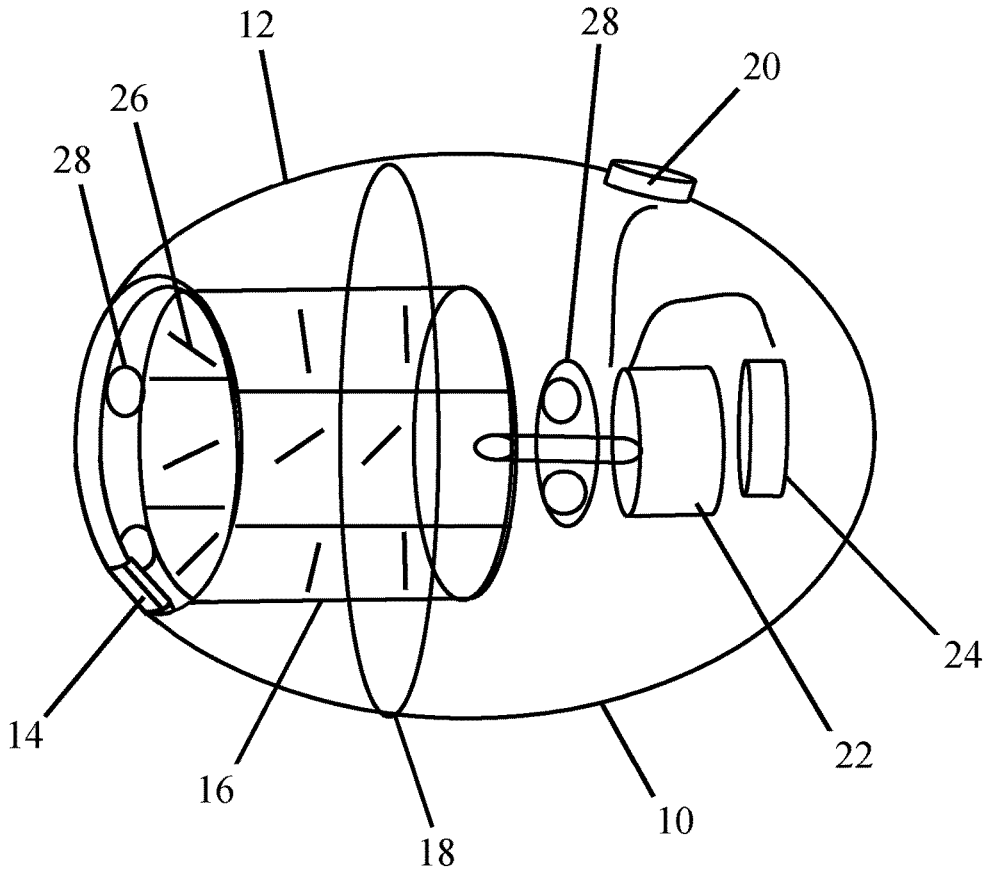
FIG. 1B is a perspective transparent view of the nail care device, according to an embodiment of the present invention.
Figure 2:
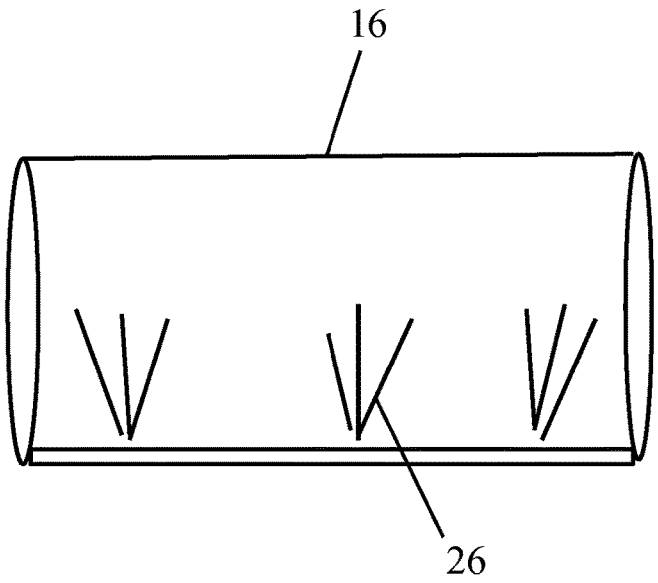
FIG. 2 is a perspective transparent view of the nail care device's bristle case, according to an embodiment of the present invention.

In an embodiment, as shown in FIGS. 1A-1B, the housing 8 includes a rear portion 10 and a front portion 12, each portion 10, 12 having a cavity therein. The rear portion 10 may be connected to the front portion 12 by an annular ridge and grooves 18, or by a twist and/or a screw. However, other attachment means can be used to connect the rear portion 10 to the front portion 12. The front portion 12 has an opening for a user's finger(s) to access the bristles 26. Attached to the front portion 12, the linger stopper 14 holds the finger(s) stern. Depending on the desired application, the finger stopper 14 can be integrated into, i.e., affixed to, or removable from the housing 8. The housing 8 is preferably elliptical or egg-shaped, as shown in FIGS. 1A-1B. However, the housing 8 can be made in any shape, including rectangular, round, square, or cylindrical. The housing cavity can be made out of plastic, rubber, metal, or any other suitable material. In a preferred embodiment, the housing 8 is palm sized. However, the housing 8 can be constructed in any size, based on the intended application. Likewise, the housing 8 can be manufactured in any color. The exterior of the housing 8 may bear a logo and/or design. The housing cavity may have dividers (not shown) separating the battery 24, the motor 22, and the bristle case 16. Other suitable configurations can be used to contain the battery 24, the motor 22, and the bristle case 16 in the housing 8. In a preferred embodiment, the power switch 20 is located on the rear cavity 10, as shown in FIGS. 1A-1B. Additionally, the power switch 20 is preferably a push button control. However, other suitable power switches 20 and locations of the power switch 20 can be used. In an embodiment, as shown in FIG. 1B. the housing 8 includes a ball bearing ring 28 for smoother movement of the bristle case 16.

The nail care device can be used as a toe nail cleaner and polisher with optimal length, width and depth, such that the housing cavity and/or bristle casing cavity would provide a suitable fit. The nail care device shown in FIGS, 1A-1B has a two-piece housing 8 that includes a front portion 12 and a rear portion 10, each portion 10, 12 having a cavity therein. However, depending on the desired application, the housing 8 could be constructed as a single-piece molding or, alternatively, it may have more than two pieces. In an embodiment, an access point (not shown) on the rear portion 10 can be used for the user to access the battery 24. In a further or alternative embodiment, the housing includes a charger port (not shown). In a further or alternative embodiment, the housing includes separation columns (not shown) to separate the bristle case 16 from the motor 22. In a further or alternative embodiment, the housing includes separation columns (not shown) to separate the motor 22 from the battery 24. In a further or alternative embodiment, the housing includes an accessible battery portal (not shown). In a further or alternative embodiment, the device includes a distinctive sound and may be altered if suitable and desired. In a further or alternative embodiment, the device includes a distinctive vibration and may be altered if suitable and desired. In a further or alternative embodiment, the device includes distinctive light(s) if suitable and desired.

Figure 3:
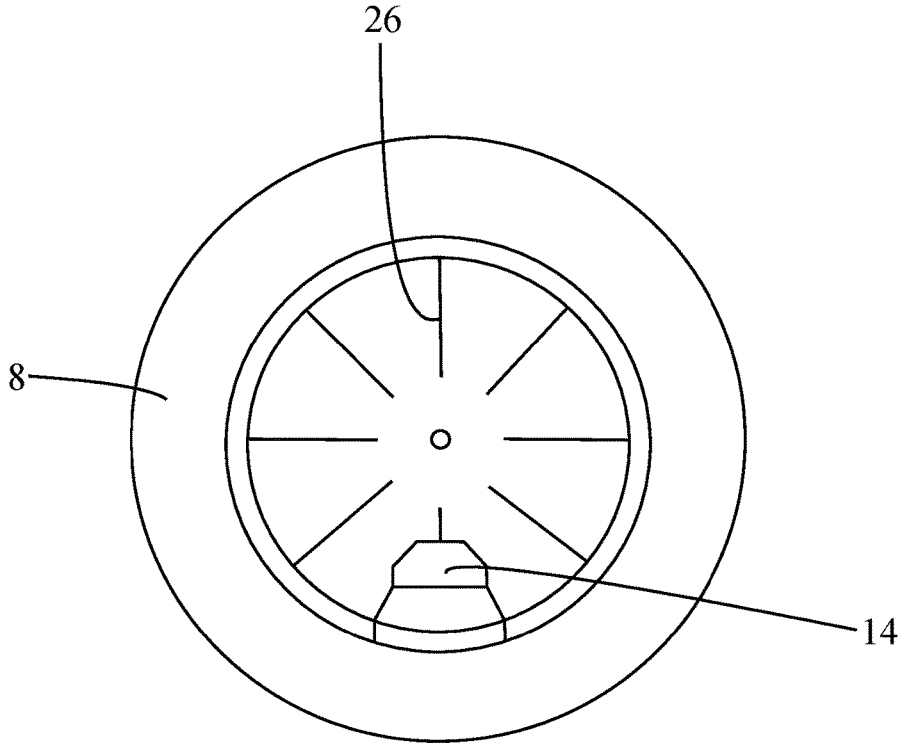
FIG. 3 is a front elevational view of the nail care device, according to an embodiment of the present, invention.

With reference to FIGS. 1A-1B and 3, the finger stopper 14 is coupled to the front portion 12. In an embodiment, the finger stopper 14 is affixed to the opening of the front portion 12 Alternatively, the finger stopper 14 is removable from the front portion 12. In a preferred embodiment, the finger stopper 14 is coated with rubber for grip. However, the finger stopper 14 can be made out of other suitable materials. In an embodiment, the finger stopper 14 includes a rubber shell to provide grip. In an embodiment, the finger stopper 14 has a half-octagon shape. However, other suitable and desired shapes can be used.

The bristle case 16 is disposed within the housing 8. In a preferred embodiment, the bristle case 16 is cylindrical in shape. However other suitable or desired shapes can be used for the bristle case 16. In an embodiment, the bristle case 16 is made of a plastic material. However, other suitable materials can be used to make the bristle case 16. The size of the bristle ease 16 will vary depending on the size of the cavity within the housing 8. In an embodiment, the device includes a ball bearing ring 28 for smoother movement, i.e., rotation, of the bristle case 16. The bristle case 16 includes insertion holes (not shown) where the bristles 26 are inserted, lined and arranged within the bristle case 16. The bristles 26 may be single or grouped in clusters. Other suitable and desired arrangements of the bristles 26 can be employed. Additionally, different grades of bristles, ranging from soft to firm for abrasion, can be used. Alternatives for the bristles 26 may be feathers and/or sponges. Other suitable and desired material in replacement and/or additional of the bristles 26 can be used.

In an embodiment, the motor 22 moves in one direction at one speed. However, a multi-directional motor, or other suitable motor, can be used, depending on the desired application. The motor 22 is powered by a power source 24. In an embodiment, the power source 24 is a battery. As shown in FIG. 1B, the power source 24 is disposed completely in the cavity of the housing 8. The power source 24 may be accessible to the user through an access point (not shown). The motor 22 and the power source 24 are disposed in electrical communication with one another. The power switch 20 transfers power from the power source 24 to the motor 22

In an embodiment, the power source 24 includes a disposable or rechargeable battery. Other suitable means of providing electrical power to the motor can be used as well. The access point (not shown) on the rear cavity 10 can be used to access the internally-disposed battery 24 for repair or replacement.

In an embodiment, the battery is charged by a plug-in a/c charger (not shown). In another embodiment, the battery is charged by a wireless a/c charger (not shown). In yet another embodiment, the battery is charged by a wireless stand a/c charger (not shown).

With reference to FIGS. 1A-1B, the power switch 20 transfers power from the battery 24 to the motor 22 when depressed. Release of the power switch 20 will discontinue power to the motor 22. In an embodiment, slow release of the power switch 20 will decrease power to the motor 22. In an embodiment, the power switch 20, as shown in FIGS. 1A-1B, is a push button. In another embodiment, the power switch 20, is a heat sensor or finger scanner. However, other suitable and desired means of power control can be used.

In an embodiment, the device includes a charger (not shown) for one or more devices. In an embodiment, the device includes a display stand (not shown) for one or more devices. In an embodiment, the device includes a display box (not shown) for one or more devices.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A nail care device comprising:

a) a housing including:
   i) a front portion having an opening extending through a proximal end thereof; and
   ii) a rear portion matingly engaged to a distal end of the front portion;

b) a finger stopper circumferentially and removably coupled to the opening, wherein at least an exterior surface of the finger stopper is rubber, and wherein a shape of the finger stopper configured to receive a user's digit is half-octagonal in a front view of the device;

c) a bristle case disposed within the housing and including a plurality of bristles disposed therein, wherein the opening opens into the bristle case;

d) a ball bearing ring coupled to the bristle case;

e) a motor rotationally engaged to a distal end of the bristle case;

f) a battery electrically connected to the motor;

g) a push button power switch electrically connected to the motor and battery, wherein a level of power delivered to the motor is regulated by a level of depression of the power switch;

wherein the housing, the finger stopper, the bristle case, the ball bearing ring, the motor, and the battery are axially aligned wherein the bristle case is rotated within the housing by the battery powered motor.

2. The nail care device of claim 1, wherein the power switch is located on an exterior surface of the rear portion.

3. The nail care device of claim 2, further comprising a charger port on the housing in electrical communication with the battery; and a charger that mates with the charger port to recharge the battery.

4. The nail care device of claim 3, wherein the ball bearing ring is located between the bristle case and the front portion of the housing and a second ball bearing ring is located between the bristle case and the motor.

5. The nail care device of claim 1, further comprising a charger port on the housing in electrical communication with the battery; and a charger that mates with the charger port to recharge the battery.

6. The nail care device of claim 1, wherein the ball bearing ring is located between the bristle case and the front portion of the housing and a second ball bearing ring is located between the bristle case and the motor.

7. The nail care device of claim 2, wherein the ball bearing ring is located between the bristle case and the front portion of the housing and a second ball bearing ring is located between the bristle case and the motor.

8. The nail care device of claim 1, wherein the housing is oval or egg shaped.

* * * * *